US012455151B2

(12) United States Patent
Jones

(10) Patent No.: US 12,455,151 B2
(45) Date of Patent: Oct. 28, 2025

(54) MULTIPURPOSE PROJECTILE APPARATUS, METHOD OF MANUFACTURE, AND METHOD OF USE THEREOF

(71) Applicant: Austin Thomas Jones, Norman, OK (US)

(72) Inventor: Austin Thomas Jones, Norman, OK (US)

( * ) Notice: Subject to any disclaimer, the term of this patent is extended or adjusted under 35 U.S.C. 154(b) by 517 days.

(21) Appl. No.: 17/850,657

(22) Filed: Jun. 27, 2022

(65) Prior Publication Data

US 2022/0341718 A1 Oct. 27, 2022

Related U.S. Application Data

(63) Continuation-in-part of application No. 17/169,450, filed on Feb. 6, 2021, now Pat. No. 11,371,817, which is a continuation-in-part of application No. 16/737,895, filed on Jan. 8, 2020, now abandoned.

(60) Provisional application No. 62/789,521, filed on Jan. 8, 2019.

(51) Int. Cl.

| | |
|---|---|
| ***F42B 33/00*** | (2006.01) |
| ***F42B 12/34*** | (2006.01) |
| ***F42B 12/74*** | (2006.01) |
| ***F42B 12/78*** | (2006.01) |

(52) U.S. Cl.

CPC ..... *F42B 33/002* (2013.01); *F42B 12/34* (2013.01); *F42B 12/74* (2013.01); *F42B 12/78* (2013.01)

(58) Field of Classification Search

CPC ..... F42B 12/78; F42B 12/745; F42B 12/34; F42B 12/74

USPC ..... 86/55; 102/514–516

See application file for complete search history.

(56) References Cited

U.S. PATENT DOCUMENTS 5,183,963 A * 2/1993 Beaufils ..... F42B 14/00 102/515

FOREIGN PATENT DOCUMENTS

WO WO-2014077793 A1 * 5/2014 ..... F42B 12/78

OTHER PUBLICATIONS

English Translation (Year: 2014).*

* cited by examiner

*Primary Examiner* — Reginald S Tillman, Jr.

(74) *Attorney, Agent, or Firm* — Bryce A. Johnson; John K. Buche; The Buceh Law Firm PC

(57) ABSTRACT

Disclosed is a projectile comprising: (1) a metal core, such as a copper alloy core, including a base and a tip, where the base and the tip are separated by a core length along a z-axis running longitudinally through a center of the metal core; and (2) a jacket circumferentially attached to the metal core, the jacket surrounding at least fifty percent of the core length of the metal core, where the jacket includes: a polymer and a first jacket radial thickness along at least a section of an interquartile portion of the core length of greater than 0.03 inches.

24 Claims, 5 Drawing Sheets

MULTIPURPOSE PROJECTILE APPARATUS, METHOD OF MANUFACTURE, AND METHOD OF USE THEREOF

CROSS-REFERENCE TO RELATED APPLICATIONS

See application data sheet.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The present disclosure relates generally to a projectile.

Discussion of the Related Art

The vast majority of conventional projectiles for use in firearms include commercially available projectiles of a solid lead alloy and projectiles of a lead or a lead alloy core that are jacketed or plated in a copper or copper alloy. Conventional projectiles further include commercially available projectiles of a lead alloy core, which are jacketed in a polytetrafluoroethylene (PTFE) coating having a thickness less than 0.020 inches. PTFE is historically known as a 0.020 inch jacketing or plating for projectiles comprising cores of brass or steel cores. Further, conventional projectiles were once thought to include projectiles otherwise identical to projectiles described above except in which the projectile core is composed of a zinc alloy and/or a bismuth alloy in place of the lead or lead alloy. Still further, conventional projectiles include commercially available projectiles composed of: (1) monolithic solid copper or a copper alloy or (2) a copper composite or sintered copper or copper alloy.

The above described more conventional projectiles are limited in scope, such as to armor penetration ability, as the compositions are non-durable materials; have excessive weight, which limits ballistic velocity; and/or are a non-ideal shape for maximizing penetration ability. Armor-penetrating projectiles have therefore been designed and used, which reliably penetrate armor by virtue of: having a composition of high durability material, being fired with an increased velocity, and/or have an armor penetration shape. Traditionally, such projectiles are composed of either a steel alloy core or a tungsten alloy core in a metal jacket or have a steel or tungsten alloy projectile contained within a discarding sabot.

The Law Enforcement Officers Protection Act of 1985, hereinafter "the Act", the text of which is incorporated by reference herein, effectively criminalized the manufacture and importation of "armor piercing ammunition" for use by the general population, where "armor piercing ammunition" is defined in the Act and in 18 U.S.C. § 921(a)(17)(B) as: (i) a projectile or projectile core which may be used in a handgun and which is constructed entirely (excluding the presence of traces of other substances) from one or a combination of tungsten alloys, steel, iron, brass, bronze, beryllium copper, or depleted uranium; or (ii) a full jacketed projectile larger than .22 caliber designed and intended for use in a handgun and whose jacket has a weight of more than 25 percent of the total weight of the projectile.

RELATED PATENTS/PUBLICATIONS

Golloher, et. al., "Fracturing and Materials Based Impact Relative Projectile, U.S. patent application publication no. 2017/0234664, Aug. 17, 2017, describe a hollow point bullet circumferentially surrounded by projectile fingers separated by kerfs longitudinally extending from a base of the bullet to a leading circumferential rim.

Statement of the Problem

A dual-use projectile for use against a soft or hard target is not readily available. Similarly, a dual-use projectile

SUMMARY OF THE INVENTION

In view of the foregoing, an object of this specification is to disclose a method of manufacture, apparatus, and method of use of a dual-use bullet, dual-use being fragmentation/expansion and armor penetration. In one embodiment, the apparatus may comprise: a projectile, comprising: (a) a metal core comprising a base and a tip, said base and said tip separated by a core length along a z-axis, said z-axis running longitudinally through a center of said metal core; and, (b) a jacket circumferentially attached to said metal core, said jacket surrounding at least fifty percent of the core length of said metal core, said jacket comprising a polymer, a first jacket radial thickness along at least a section of an interquartile portion of said core length of greater than 0.03 inches, and less than twenty-five percent of a total mass of said projectile. According to this particular embodiment, the apparatus may have a jacket which further comprises: a cylindrical geometric section comprising a smooth outer-surface along at least twenty percent of said interquartile portion. Additionally, the apparatus could include wherein the metal core is composed of at least five, ten, twenty, forty, sixty, eighty, or ninety percent by mass of a metal alloy selected from the group consisting essentially of a copper alloy, tungsten alloy, steel alloy. In other embodiments, said metal core might comprise a sintered copper alloy. This particular projectile, when the projectile is fired into a fluid-like body, may result in hydrostatic pressure within the jacket initiating expansion and/or fragmentation of the jacket off of and/or away from the metal core. The projectile may also include a jacket comprising a material that luminesces when optically charged or charged by mechanical strain.

In the same embodiment, the apparatus may have a metal core that further comprises: a metal core radial thickness along said interquartile portion of said core length, wherein a ratio of said first jacket radial thickness-to-said metal core radial thickness comprises at least forty percent. The apparatus may also have a jacket comprising at least one of: polycarbonate; polyetherimide; polymethyl methacrylate; polyoxymethylene; polyimide; polyamide; Polyamide-imide; Polyphenylsulphone; Acrylonitrile butadiene styrene; and, Polyether ether ketone. The jacket could also, in some embodiments, further comprise: a second jacket radial thickness along at least a section of a lower quartile of the core length relative to said base, said second jacket radial thickness at least ten percent thicker than said first jacket radial thickness.

In other modes and embodiments, a projectile could comprise: a ratio of a first total mass of said jacket-to-a second total mass of said metal core exceeding twelve percent. Suitably, the metal core may have a tensile strength in a range of 40 to 300 kilopounds per square inch while the jacket could further comprise: a cylindrical section; and a base section attached to said cylindrical section, said metal core positioned both: (1) on said base section and (2) within said cylindrical section, where said cylindrical section further comprises: a cylindrical section length less than said core length. In some cases, the jacket and metal core may further include an adhesive comprising a layer bonding an outer surface of said metal core to an inner joint surface of said jacket, wherein said adhesive suitably has a pre-hardened viscosity in a range of 1 to 10,000 centipoise. In a preferred embodiment, the adhesive is selected from a group of adhesives consisting essentially of Cyanoacrylate, Epoxy, or Acrylic.

In one mode of assembly, a projectile may be achieved via the steps of: producing a metal core comprising a base and a tip, said base and said tip separated by a core length along a z-axis, said z-axis running longitudinally through a center of said metal core; producing a polymer jacket comprising a base section attached to a hollow cylindrical section with a first jacket radial thickness along at least a section of said cylindrical section of greater than 0.03 inches; applying an adhesive to a floor of said base section at a location that is within said hollow cylindrical section; positioning the metal core within said cylindrical core such that said jacket surrounds at least fifty percent of the core length of said metal core and such that said adhesive forms a layer bonding an outer surface of said metal core to an inner joint surface of said jacket. Other steps could be the steps of machining, sintering, or forging the metal core or machining, injection-molding, or printing the polymer jacket.

Another preferred embodiment may be a projectile that is configured to expand in unarmored targets and penetrate armored targets. In the preferred instance, the projectile could be defined by: a metal core that is geometrically defined by a cone at the tip and a cylinder at the base, where said cone features an outer surface that is angled by thirty degrees relative to the outer surface of the cylinder, where the cone and cylinder share a diameter and a coaxis; a polymer jacket that features a cylindrical receptacle wherein the metal core is disposed, said jacket further featuring a tip defined around the cylindrical receptacle, wherein the tip is defined by an angled edge of the cylindrical receptacle so that an external surface of the tip is angled by twenty four degrees relative to the inside surface of said cylindrical receptacle.

In yet another embodiment, the disclosure may describe a projectile defined by: a metal core that is geometrically defined by tip and a cylinder at the base, where said tip features an outer surface that is seamlessly joined to the outer surface of the cylinder, where the cone and cylinder share a diameter and a coaxis; a polymer jacket that features a cylindrical receptacle wherein the metal core is disposed, said jacket further featuring a tip defined around the cylindrical receptacle, wherein the tip is defined by an angled edge of the cylindrical; and wherein the diameter of the cylindrical receptacle is configured to expand by more than one-hundred percent when the projectile contacts an unarmored target and the tip of the metal core is configured to penetrate an armored target.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures (wherein like reference numbers refer to similar items throughout the Figures) in which.

Figure 1:
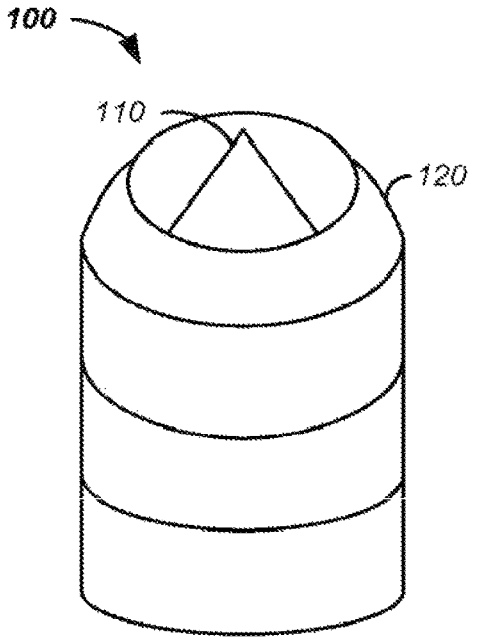
FIG. 1 illustrates a projectile.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PROFFERED EMBODIMENTS

The specification describes a projectile that is, in certain embodiments, compliant with the U.S. Code of Federal Regulations and/or the United States Code, such as 18 U.S.C. § 921(a)(17)(B), which regulates bullet materials and mass fractions. For example, this specification describes a projectile comprising: (1) a metal core, such as a cobalt alloy core or, in the alternative, a copper alloy core, said core including a base and a tip, where the base and the tip are separated by a core length along a z-axis running longitudinally through a center of the metal core; and (2) a jacket circumferentially attached to the metal core, the jacket surrounding at least fifty percent of the core length of the metal core, where the jacket includes: a polymer and a first jacket radial thickness along at least a section of an interquartile portion of the core length of greater than 0.03 inches.

The present inventive subject matter comprises ammunition, which when properly employed enables handguns and long guns to more easily penetrate armor compared to the same gun operating with more conventional projectiles, while maintaining compliance with federal prohibitions on the manufacture and importation of "armor piercing ammunition" for general uses.

Herein, a projectile, also referred to as a bullet, to be used in a firearm is comprised of: (1) a jacket, such as a polymer jacket and (2) a metal core which is enveloped by and/or at least partially fixed within the jacket.

Despite the definition of 18 U.S.C. § 921(a)(17)(B), described supra, a projectile or projectile core of sufficient durability, velocity, and/or shape may be armor-penetrating without being in the scope of the definition of "armor piercing ammunition" provided in 18 U.S.C. § 921(a)(17)(B). The language of the prohibition applies only to handgun ammunition, but the advent of pistols chambered for rifle cartridges has allowed controllers to enforce the regulation on projectiles for many common rifle cartridges as well. This has led to a market demand for armor-piercing ammunition, which falls outside the scope of 18 U.S.C. § 921(a)(17)(B). More particularly, consumers wish to possess such ammunition for antipersonnel capability, for use against animals, to utilize the unique ballistic properties of such ammunition, out of curiosity, and for sport and entertainment.

Herein, the word "armor" used in any description of this inventive subject matter is to be broadly interpreted to mean any protective layer on and/or around and/or in front of any ballistic target, including but not limited to, garments and barriers intended for ballistic protection, garments and barriers not intended for ballistic protection, animal hide, and/or tissue. Therefore, projectiles designed and used to penetrate armor may find broad and appreciable application in hunting, anti-personnel application, and protection from dangerous/threatening animals.

Herein, a z-axis passes longitudinally through the bullet from a tip of the bullet, through a longitudinal axis through the center of a core of the bullet, and out through the base of the bullet and an x/y-plane is perpendicular to the z-axis. For a $C_\infty$ bullet about the z-axis, the radial cross-section of the bullet is the same along the x-axis and the y-axis.

Herein, the term "armor" is to be broadly interpreted to mean any outer protective layer on, around, and/or, in front of any ballistic target, including but not limited to, garments and barriers intended for ballistic protection, garments and barriers not intended for ballistic protection, and/or a portion of an animal, such as animal hide, bone, and/or tissue.

The present disclosure pertains to ammunition for use against a soft target and a hard target. For example, ammunition for use against a soft target includes ammunition for use against animals, including but not limited to cases of game hunting and protection from dangerous or threatening animals, and against personnel, including but not limited to personnel who may be wearing body armor and the same who may be obscured by substantial barriers. Further, ammunition for use against hard targets includes ammunition, functioning with a higher velocity and lower recoil featured by such a projectile, for use in sport shooting, competition shooting, and/or for use as an armor-penetrating projectile. More particularly, the same bullet is used for both soft targets and hard targets, as further described infra.

Bullet/Projectile

Referring now to FIG. 1, a projectile 100, which is also referred to as a bullet, is described. As illustrated, the projectile 100 includes: a core material, such as a metal core 110 and a jacket 120, such as a polymer jacket, a polycarbonate jacket, and/or a polyetherimide jacket. More particularly, the metal core 110 is axially centered and fixed within the jacket 120 to form a cohesive projectile, which is referred to herein as the projectile 100. Generally, the cohesive projectile survives intact during ballistic flight until impact, where the metal core 110 functions against a hard target and the jacket 120 functions against a soft target. As further described, infra, the metal core 110 and the jacket 120 are optionally and preferably independently produced and are optionally affixed to one another, in a manufacturing process, by an adhesive and/or through the use of a mechanical press. For clarity of presentation and without loss of generality, several examples of the projectile 100 are provided herein.

Example I

In a first embodiment, the projectile 100 is an armor-penetrating bullet that is used to penetrate armor. The presented example of an "armor-penetrating" projectile also includes the case of frangible ammunition which is designed not to penetrate at all. In this armor-penetrating bullet example, the metal core 110 and the jacket 120 remain affixed to each other as a cohesive unit during the course of ballistic flight, the metal core 110 functions as an armor penetrator upon impact with armor, and the jacket 120 disintegrates, fragments, and/or deforms upon impact with the target, which may or may not result in auxiliary damage to the target, beyond the armor-penetrating ability of the projectile. For instance, the jacket 120 is shed from the metal core 110 by drag forces induced by the target or armor thereof onto the projectile 100. In one illustrative case of shooting hard sporting targets, such as a target cut from a steel plate of at least 400 Brinell hardness and at least 0.25 inches thick, both the metal core 110 and the jacket 120 disintegrate upon impact with the hard sporting target, where the projectile experiences massive/total structural failure while the hard sporting target remains significantly undamaged. However, when striking a soft target, the jacket 120 deforms while passing into and/or through the target, which enhances damage to a soft target over the use of the metal core 110 without the jacket 120, as further described infra.

Projectile Core

Still referring to FIG. 1, the metal core 110 of the projectile 100 is further described. Key features of the metal core 110, in terms of armor penetration capability, are mass, density, velocity, geometry, and/or resistance to deformation upon impact.

Still referring to FIG. 1, as to mass, many autoloading firearms rely on a projectile of sufficiently heavy mass to impart sufficient recoil into the firearm as to cycle the action of the firearm; hence, projectiles of insufficient mass may cause failure to cycle a firearm action. Herein, the projectile 100 is optionally and preferably of sufficient mass to operate in autoloading firearms. As to density, generally, a ballistic penetrator of high density is desirable for the penetration of armor to increase penetrator ballistic momentum per unit of penetrator volume, which minimizes velocity loss during momentum transfer on impact. Desirable density is further driven by the inability of firearms in general to impart as much kinetic energy into a projectile of lower mass compared to a projectile of higher mass, where caliber of the projectile 100 is limiting. Further, a higher density reduces adverse kinetic effects of air drag on ballistic trajectory and characteristics. Hence, optional and preferable densities of components for use in the metal core 110 exceed 7 g/cm.sup.3, which is sufficient to gain and maintain momentum for penetration of a hard target. High velocity is also an aspect of a ballistic penetrator effectiveness against armor, which is enabled by weight reduction. Therefore, in one cast, metal(s) used to compose the metal core 110 having a density of less than lead or lead alloys and/or a density of less than 11 g/cm.sup.3 are optionally preferred. Similarly, control of density and/or geometry of the projectile 110 is used to enhance resistance to deformation of the metal core 110 of the projectile 100, such as in a case of use as a ballistic penetrator, is in-part accomplished through increasing, maximizing, and/or controlling toughness and/or resistance to structural failure upon impact in both the ductile and brittle modes.

To ensure that neither the projectile 100 nor the metal core 110 of the projectile 100 is restricted for use in a handgun, under the Code of Federal Regulations and/or United States Code, including but not limited to 18 U.S.C. § 921(a)(17)(B), (i) the metal core 110 must not be manufactured to compose entirely (excluding the presence of traces of other substances) of one or a combination of tungsten alloys, steel, iron, brass, bronze, beryllium copper, depleted uranium, or any other material which may classify a projectile or projectile core as "armor piercing ammunition", where (ii) the jacket is greater than twenty-five percent of the weight of the projectile. Notably, the inventor has determined that elemental cobalt and cobalt alloys are not excluded by the above cited regulations. Hence, cobalt and cobalt alloys may be used to form the metal core 110 of the projectile. In particular, cobalt M35N and/or MP35N is optionally used as an element of the metal core 110. Cobalt M35N is a multiphase cobalt-based alloy with a high percentage of nickel, chromium, and molybdenum. Like similar alloys, M35N is non-magnetic. Further, M35N is characterized by an ultra-high tensile strength of up to 300 kilopounds per square inch (ksi) or 2070 mPa, and depending on the work-strengthening method used, has excellent ductility and toughness properties including use, in a fully-hardened condition, at service temperatures up to 750.degree. F. (400.degree. C.). Thus, cobalt M35N is optionally used as the metal core 110 for use in a projectile 100, for use in/with a handgun, and/or for use as a ballistic fired from a handgun. The cobalt M35N has a compositional designation UNS R30035. Composition of cobalt M35N is provided in Table 1. Optionally and preferably, the metal core 110 comprises: greater than 27, 28, 29, or 30 percent cobalt; less than 37, 38, 39, or 40 percent cobalt; greater than 30, 31, 32, or 33 percent nickel; less than 21, 22, 23, or 24 percent nickel; greater than 16, 17, 18, or 19 percent chromium; less than 21, 22, 23, or 24 percent chromium; greater than 6, 7, 8, or 9 percent molybdenum; less than 10, 10.5, 11, 12, or 13 percent molybdenum; 0 to 2 percent titanium; 0 to 2 percent iron; and/or less than 0.5% of each of manganese, silicon, or other trace element. The alloy M35N is also optionally referred to as MP35N. Generally, the metal core 110 is optionally and preferably non-ferrous, such as less than 0.25, 0.5, 0.75, 1, 2, or 3 percent iron.

TABLE-US-00001 TABLE 1 Components of M35N Concentration Component (percent) cobalt balance nickel 33-37 chromium 19-21 molybdenum 9-10.5 titanium 1 iron 1 manganese 0.15 silicon 0.15 each of other trace <0.15 elements.

Figure 2:
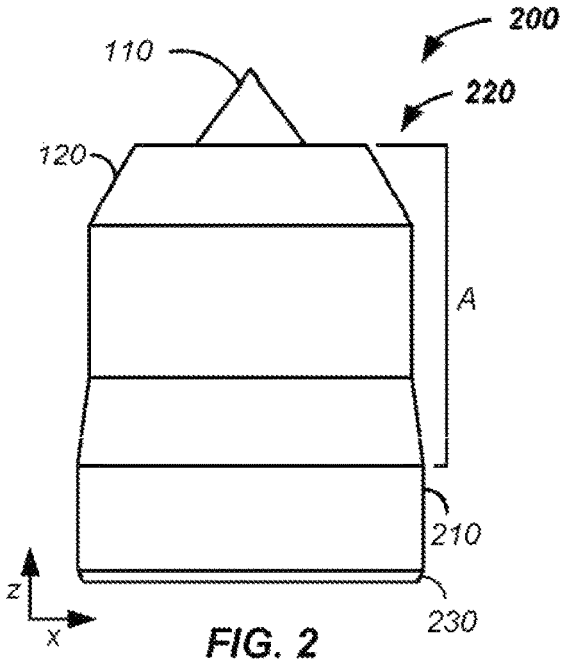
FIG. 2 illustrates a bullet with an ogive geometry.

Referring now to FIG. 2, a bullet with an ogive shape 200 is illustrated. Herein, an ogive 220 refers to a bullet point, where a curve or set of angles from the bullet tip increases in radial diameter as a curve and/or a set of angles from the bullet tip to a full diameter of the bullet, such as along a longitudinal straight section of the bullet and/or a shank of the bullet. Section A of FIG. 2 illustrates an x/y-plane and z-axis of the ogive 220. As illustrated, the bullet with the ogive shape 200 is an example of the projectile 100. A bearing surface 210 of the bullet is additionally illustrated, which is optionally and/or preferably the full diameter of the bullet. The projectile 100 and/or, as illustrated, the bullet with the ogive shape 220 is optionally configured with a chamfer 230, such as a rear chamfer, of greater than ten and less than fifty degrees, relative to an elongated longitudinal axis of the bullet. A preferred rear chamfer is thirty degrees.

Multi-Part/Two-Part Bullet

Figure 3:
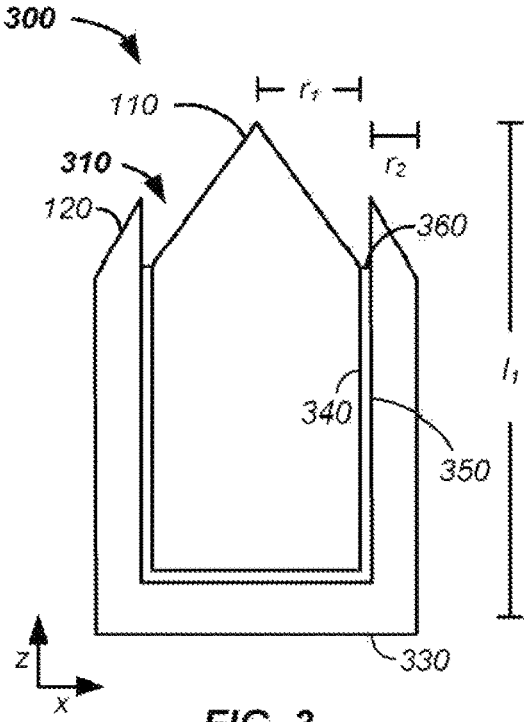
FIG. 3 illustrates a two-part bullet.

Referring now to FIG. 3, a multi-part bullet, such as a two-part bullet 300 is illustrated. Generally, the two-part bullet is an example of the projectile 100, where the metal core 110 and the jacket 120 are assembled into a single unit from two or more separate pieces. The assembly/method of manufacturing process is further described infra.

Still referring to FIG. 3, relative cross-section proportions of the metal core 110 and the jacket 120 of the two-part bullet 300 are described, where the two-part bullet 300 is an example of the projectile 100. Herein, for clarity of presentation and without loss of generality, radial thicknesses on an x/y-plane perpendicular to a z-axis running through the center of the projectile 100 are used to describe thickness of the metal core 110 and the jacket 120. However, it is understood that the explanation here of radial thickness applies to a description of the diameters and/or fractions of the bullet cross-section shape, such as extending radially outward from the z-axis to an outer edge of the bullet. As illustrated, the metal core 110 has a first radial thickness, $r_1$, and the jacket 120 has a second radial thickness, $r_2$. As further described, infra, the jacket 120 optionally and preferably has a range of radial thicknesses. For clarity of presentation and without loss of generality, three exemplary radial thicknesses for both the metal core 110 and the jacket 120 as a function of common handgun bullet calibers are provided in Table 2.

TABLE-US-00002 TABLE 2 Bullet Core and Jacket Thicknesses Jacket Radial Core Radial Jacket: Core Thickness Thickness Thickness Caliber (inches) (inches) (percent) 0.224 in 0.044 0.0675 65.9 9 mm 0.053 0.125 42.4 10 mm 0.076 0.125 60.8

As seen from the three examples in Table 2, the jacket-to-core ratio ($(r_2/r_1)*100$) is 66, 42, and 61 percent. More generally, a radius of the metal core 110, $r_1$, and/or a thickness of the jacket 120, $r_2$, are optionally adjusted to yield a jacket-to-core radial thickness ratio of greater than 22, 25, 30, 40, 50, or 60 percent. Notably, the thin coatings placed on a .224 caliber bullet that are available do not exceed 0.020 inches of radial thickness, which yields a thin radial coating-to-radial core ratio of 21.74%.

Still referring to FIG. 3, the two-part bullet 300 has a density differing from traditional bullets as further described herein. Again, for clarity of presentation and without loss of generality, three exemplary jacket-to-bullet mass ratios are provided in Table 3. More particularly, the jacket mass for a PTFE coated bullet is provided in Table 3 along with a total mass of the projectile for three bullets provided by the inventor are provided in Table 3, where the three bullets are to common handgun bullet calibers of 0.224 inches, 9 mm, and 10 mm. In Table 3, for the thicknesses of the jacket 120 provided in Table 2, the mass of the jacket, for the particular case of a polytetrafluoroethylene jacket material, is provided along the total mass of the resulting projectile with a necessarily thinner metal core 110. Particularly, the jacket mass-to-total projectile mass percentage is 16, 12, and 16 percent for the 0.224 inch, 9 mm, and 10 mm bullets described in Table 2. More generally, the jacket 120 for each caliber is optionally thinner or thicker and the material of the jacket 120 optionally comprises any plastic, fluorocarbon, perfluorocarbon, or chlorofluorocarbon. Notably, a 0.224 inch diameter bullet that includes a 0.02 inch radial thickness PTFE coating has a metal core mass of 47.8 grains and a jacket mass of 4.9 grains, which is a jacket mass-to-core mass of 10.3 percent. Generally, the projectile has a jacket mass-to-core mass percentage greater than 10.5, 11, 12, 13, 14, 15, or 16 percent. Calculations herein use a lead core density of 11.35 g/cm.sup.3 and a PTFE density of 2.2 g/cm.sup.3, where similar mass ratios are readily calculated for other metal core 110 and jacket 120 materials, such metal alloys and plastics, respectively.

TABLE-US-00003 TABLE 3 Projectile Jacket Mass-to Core Mass Ratio Jacket Mass Bullet Mass Jacket Percent of Caliber (grains) (grains) Total Mass 0.224 in 4.65 29.3 15.9 9 mm 6.00 48.5 12.4 10 mm 9.44 57.6 16.4

Metal Core

Figure 4:
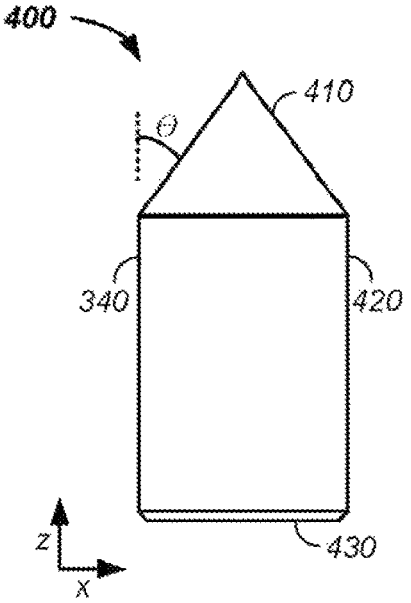
FIG. 4 illustrates a metal core of the two-part bullet.

Referring now to FIG. 4, the metal core 110 section of the two-part bullet 300 is further described. The metal core 110 includes a forward end or forward tip 410, such as, along a longitudinal axis of the metal core 110, a pointed forward end or pointed forward tip. The geometry of the forward tip optionally and preferably includes a first x/y-plane cross sectional area at the forward end that is less than a second x/y-plane cross-sectional area at the widest section of the metal core 110, such as by the bearing surface 210. For example, the metal core 110 optionally and preferably includes a conic and conicoid (solid of revolved conic section) geometrical shape, which reduces cross-sectional areas as a function of z-axis position approaching the forward tip 410. However, the forward tip 410 is optionally of any geometry that reduces x/y-plane cross-section area as a function of position along the z-axis approaching the forward tip 410, such as: a revolution of a conic section, a spline, a cone, and/or a wedge shape. Further, a reduction in x/y-plane cross-section area as a function of position along the z-axis approaching the forward tip 410 increases armor penetration ability by further increasing resistance to deformation of the metal core 110 through use of a more stable geometry resisting target body applied forces upon impact. Further, the reducing x/y-plane cross-section area as a function of position along the z-axis approaching the forward tip 410 increases armor penetration ability by concentrating impact loading on the armor imparted by the penetrator on a smaller volume of the armor. An angle, θ, between the longitudinal axis and an exemplary sloping axis from an upper end of a core body 420, described infra, of the metal core 110 is optionally and preferably in a range of greater than 5, 10, 15, or 20 degrees and less than 40, 45, 50, or 55 degrees. A preferred angle, θ, is thirty degrees.

Still referring to FIG. 4, the metal core 110 includes the core body 420 between the forward tip 410 and a trailing end 430 of the projectile 100. The trailing end 430 is optionally chamfered, as further described supra. More particularly, the projectile 100 includes the core body 420, which is a portion of the metal core 110 that is positioned rearward of any distinct element of the forward tip 410 and/or is positioned forward of any distinct geometry at the trailing end 430 of the metal core 110. The core body 420 of the metal core 110 is optionally and preferably a cylinder geometry. Alternatively, in the case of a spherical projectile, the forward tip 410 and trailing end 430 are merely opposite sides of the sphere at any given point in time. In an optional and preferred embodiment, the projectile 100 includes a metal core 110 having a cylindrical body 420. Optionally, the core body 420 of the metal core 110 is an extrusion shape, such as through a mold of any x/y-axes cross-section geometry. Examples of x/y-axes cross-sections include a regular polygon or star pattern. Optionally, the core body 420 of the metal core 110 is tapered from one end to the other, spherical, of conicoid shape, or is otherwise irregular and/or is non-constant in profile, as described supra.

Referring again to FIG. 3, an outer surface 340 of the metal core 110 and/or the core body 420 is also referred to herein as a joint surface and/or an adhesion surface of the metal core 110. Optionally and preferably the outer surface 340 of the metal core 110 is attached to and/or is affixed to the jacket 120, as further described infra.

The metal core 110 is optionally composed of any metal of desirable density that is: (1) not a cobalt or cobalt alloy and (2) not classified as "armor piercing ammunition" under the Code of Federal Regulations and/or United States Code, such as 18 U.S.C. § 921(a)(17)(B). Such embodiments may be intended and/or more appropriate for the penetration of armor other than modern engineered armor, including but not limited to, animal hide, bone, animal flesh, construction materials, and natural objects. Some projectiles intended for use against such non-engineered armors may be often referred to as "barrier blind", and embodiments of the described projectile intended for use against such non-engineered armors may find useful purpose in applications including but not limited to, hunting and protection from dangerous and/or threatening animals and more general personal defense, in which the user may desire lower recoil and/or increased ballistic velocity and/or a small increase in penetration ability relative to more conventional projectiles.

Jacket

Still referring to FIG. 3, the jacket 120 is further described. As described supra, the jacket 120 optionally comprises a total thickness, such as radial thickness of the projectile 100, and/or comprises a percentage mass of the projectile 100. Herein, the jacket 120 is described in terms of longitudinal coating of the projectile 100 and/or a back-side coating of the projectile 100. Herein, the projectile has an overall length, l.sub.1. Herein, the length, l.sup.1, of the bullet is described as starting at the base of the projectile, such as the surface contacting a support platform when the projectile 100 is placed on the support platform with the longitudinal z-axis of the projectile 100 aligned with gravity, and running to the forward tip 410. For instance, a scale of 0 to 100 runs from the base of the projectile to the forward tip 410. Optionally and preferably, the jacket 120 circumferentially, on an x/y-axis, surrounds the metal core 110, on the 0 to 100 scale, at any of the 10, 20, 30, 40, 50, 60, 70, or 80 percent marks. Optionally and preferably, the jacket 120 extends from at least the 0, 2, 5, 10, or 20 percent of the 0 to 100 scale to at least the 40, 50, 60, 70, or 80 percent mark of the 0 to 100 scale. Optionally and preferably, the jacket 120 circumferentially encompasses at least an inter-quartile length, a middle fifty percent, and/or an H-spread of the metal core 120. Optionally and preferably, the jacket extends from a portion in the lower quartile to a portion in the upper quartile of the length of the projectile, such as from 0-25 to 75-100 percent of the length of the projectile 100. Optionally and preferably, the outer perimeter of the jacket 120, along an x/y-plane of the projectile, is circular without kerfs cut into the jacket 120. Further, a first x/y-plane radial thickness of the jacket 120 in the first quartile, from the base of the bullet, is at least 5, 10, 15, 20, 25, 30, 40, 50, 75, or 100 percent greater than a second x/y-plane radial thickness of the jacket 120, such as in an interquartile section and/or in an fourth quartile of the longitudinal length of the jacket 120. The jacket 120 optionally and preferably includes a floor section 330, which connects across the base of the projectile to walls of the jacket 120. Herein, the walls of the jacket circumferentially encompass the metal core 110 along x/y-axes along the length of the projectile 100, as described supra.

Still referring to FIG. 3, the jacket 120 is further described. A bare ballistic penetrator, such as the metal core 110 of full bullet size, constructed of cobalt alloy or other alloy preferable to compose a ballistic penetrator for armor penetration fired through the barrel of a firearm induces major and/or catastrophic damage to a firearm barrel as the penetrator of the alloys may not readily take the form of the interior of the barrel and/or may be abrasive to the metal composition of the barrel. Other metals desirable for composing a ballistic penetrator to penetrate armor, or a projectile for sport and/or competition shooting, may transfer residue, or fouling, to the barrel. For these reasons, the described projectile 110 comprises the jacket 120 in addition to a metal core 110, where the jacket 120 comprises one or more outer surfaces of the projectile 100, such as the bearing surface 210 of the projectile 100 in and against a firearm barrel. Many modern polymers are adequately durable for use as a projectile version of the jacket 120, where the jacket 120 of the projectile 100 is composed of polymers that readily take the form of a firearm barrel, minimize barrel wear relative to jackets of more conventional construction, and/or leave no detectable fouling residue when fired through the barrel. Further, polymers are generally less expensive than materials of conventional thin, less than 0.020 inch thick, projectile jackets, and deform more readily and consistently than more conventional materials for composing the traditional thin coating, less than 0.020 inch thick, projectile jackets, which ensures more predictable and/or proper disintegration on impact into armor or on a hard sporting target and a more consistent terminal behavior. For these reasons, the jacket 120 of the described projectile is optionally and preferably composed of a polymer, which may also include composite materials thereof.

Figure 5:
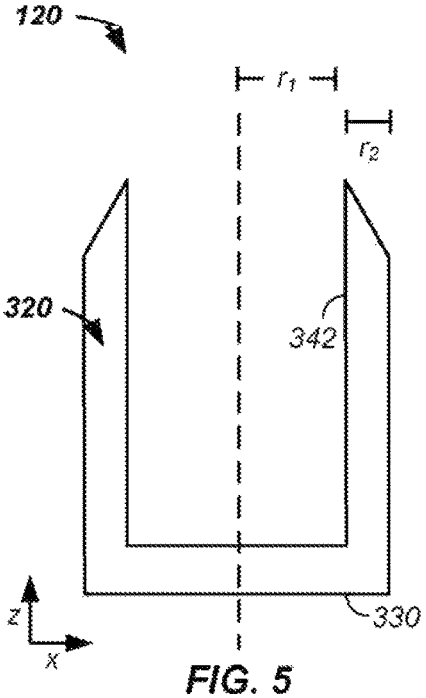
FIG. 5 illustrate a jacket.
Figure 8:
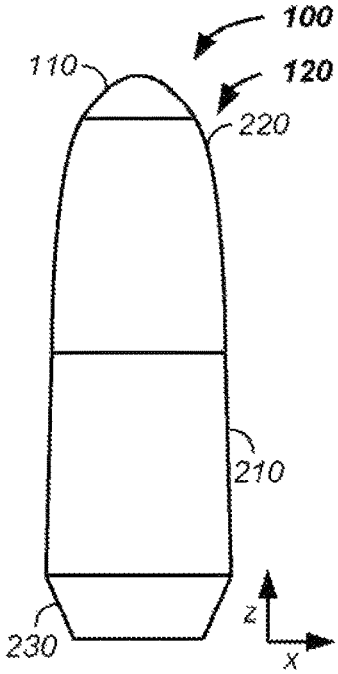
FIG. 8 also illustrates a long bullet.
Figure 9:
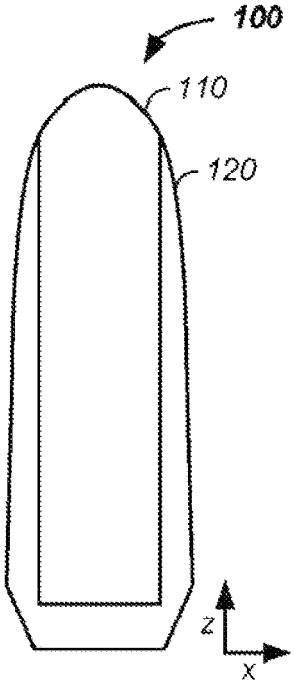
FIG. 9 further illustrates a long bullet.

Referring now to FIG. 5, the jacket 120 of the projectile 100 is further described. In one example, the jacket 120 comprises a polymer material. The jacket 120 optionally and preferably includes one or more geometric features, such as: a jacket body 320 on which is found at least the projectile bearing surface 210 on the exterior of the jacket body 320, and an inner surface 342, also referred to herein as a joint surface 340, on the interior surface of the jacket body 320, which closely follows the geometry of at least a portion of the outer surface 340 of the metal core 110. Sections of the jacket body 320, in x/y-planes orthogonal to the axis of general symmetry of the projectile 100 are generally ring-shaped, where the outer bounds of the rings are optionally and preferably circles and the inner bounds of the ring are optionally and preferably circular in shape or are optionally a closed polygon or conic section. The bearing surface 210 found on the jacket body 320 is optionally and preferably continuous, as in the embodiment illustrated in FIG. 5, or interrupted so to cause discontinuities between rings which engage a firearm barrel when fired in a firearm. Other features, including but not limited to the ogive, are optionally included as geometric elements of the jacket 120. In optional and preferred embodiments, the jacket body 320 includes a floor 330, which at least partially, or more preferably entirely, encloses the trailing end 430 of the metal core 110 and also comprises the rear of the projectile 100. The floor 330 is desirable for aspects of projectile assembly, discussed infra, to facilitate fixing the metal core 110 within the jacket 120. Generally, the floor 330 of the jacket 120 is optional. Further, preferred embodiments of the jacket 120 exhibit a projectile ogive 220, which as described supra is projectile geometry forward of the bearing surface 210, which may include the location on the exterior of the projectile which first engages barrel rifling when fired in a rifled firearm. The ogive 220 geometry of the jacket 120 is optional. Optional and preferred embodiments of the jacket 120 of the described projectile possess a distinct geometry at the chamfer 230 of the jacket 120, such as a tapered x/y-plane cross-section area of the bearing surface 210 of the projectile into smaller cross-section areas approaching the trailing end 430 of the projectile 100. In optional and preferred embodiments, the distinct geometry serves to ease loading of the described projectile 100 into a cartridge case and/or to function as a "boat tail" to reduce air drag on the projectile 100 during ballistic flight. The jacket 120 of an optional and preferred embodiment of the described projectile 100 is the same as a 9 mm. Other exemplary embodiments illustrated in the figures also exhibit a chamfer 230 of about 30 degrees at the rear of the jacket 120, but is illustrated in FIGS. 8 and 9 with a larger chamfer angle, referred to as a boat tail. Other embodiments optionally exhibit no distinct feature at the rear of the jacket 120, or chamfer feature of any geometry, including but not limited to one or more of: a chamfer of any angle, a fillet, a rotation of a conic section, a cone, a pyramid, and/or a wedge shape.

Example I

Figure 6A:
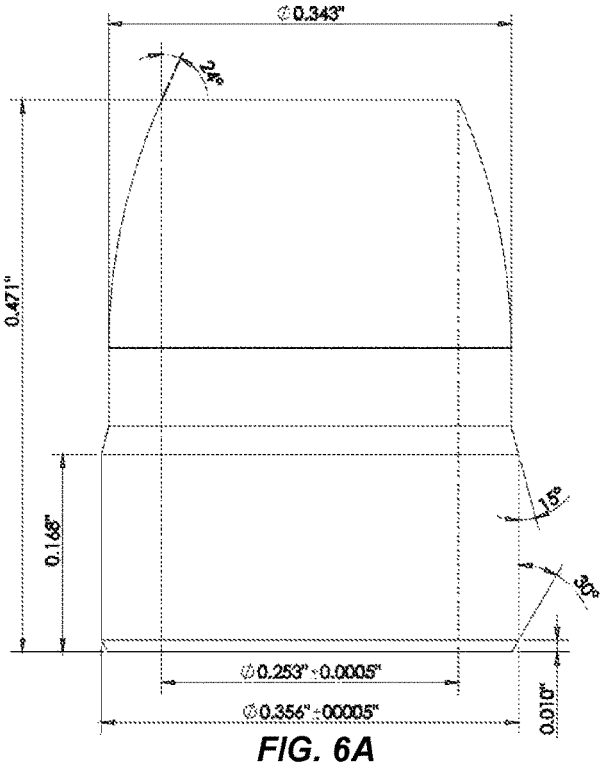
FIG. 6A illustrates the preferred dimensions of a multi-section jacket.
Figure 6:
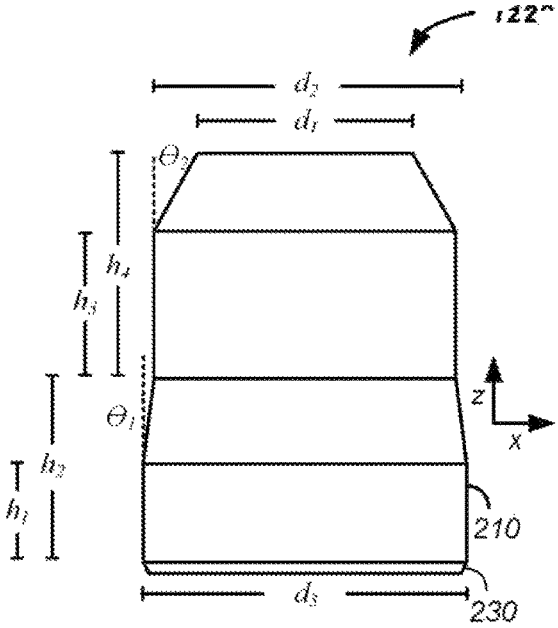
FIG. 6 illustrates a multi-section jacket.

Referring now to FIG. 6, for clarity of presentation and without loss of generality, a multi-section jacket 122 example of the jacket 120 is illustrated. In this example, the multi-section jacket 122 includes three diameters, a first diameter, $d_1$, at a leading edge and/or at least partially within an upper quartile of the projectile 100; a second diameter, $d_2$, such as at least partially within an interquartile length of the projectile 100; and a third diameter, d.sub.3, at a trailing edge and/or at least partially within a lower quartile of the projectile 100. As illustrated, the projectile 100 includes a first chamfer, $\theta_1$, and a second chamfer, $\theta_2$, respectively between: (1) an upper and middle section of the projectile 100 and (2) the middle section and a lower section of the projectile 100, where the chamfers are of any angle or angles. Each of the two sections of the multi-section jacket 122 are of any radial thickness and optionally differ from one another by greater than 1, 2, 5, 10, 15, 20, 25, 30, 40, or 50 percent. The jacket sections and/or jacket and chamfer sections have independent heights, which are optionally the same height or differ from one another by greater than 1, 2, 5, 10, 15, 20, 25, 30, 40, or 50 percent. As illustrated, the first jacket section has a first height, $h_1$; the first jacket section and first chamfer have a second height, $h_2$; the second jacket section has a third height, $h_3$; and the second jacket section and second chamber have a fourth height, $h_4$. More generally, the multi-section jacket has any number of sections, such as 1, 2, 3, 4, 5, 6, or more sections. Optionally and preferably, the sections of the multi-section jacket are of one continuous part, such as a machined part.

Projectile Shape

The shape of the projectile 100 was described supra for a hollow point bullet. Two additional examples, provided infra, described alternative geometries of the projectile 100. More generally, the projectile 100 is of any shape having a metal core 110 and a jacket 120.

Example I

Figure 7:
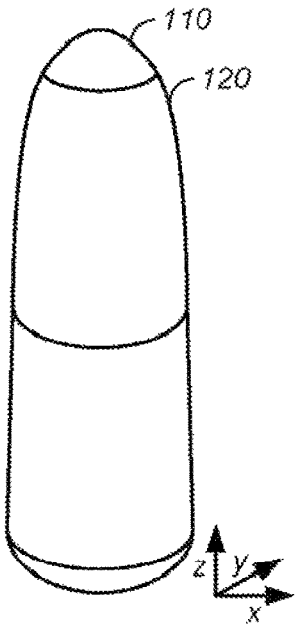
FIG. 7 illustrates a long bullet.

Referring now to FIGS. 7-9, a second bullet shape of the projectile 100 is illustrated. The second bullet shape optionally and preferably includes the metal core 110 and the jacket 120, as described supra. The second bullet shape is an example of another caliber bullet. Optionally, and preferably, the metal core 110 is composed of, includes, and/or comprises cobalt or a cobalt alloy including but not limited to UNS R30035, which is a legally unrestricted material, such as for armor penetration. The metal core may optionally be composed of copper or copper alloy, steel or tungsten instead of cobalt/cobalt alloy. The metal core 110 is optionally composed of one or more of the first materials defined as "armor piercing ammunition" and/or is optionally composed of second material not defined as "armor piercing ammunition" under the Code of Federal Regulations and/or United States Code, such as 18 U.S.C. § 921(a)(17)(B). The metal core 110 is optionally useful as a penetrator effective in penetrating modern engineered armors.

Example II

Figure 10:
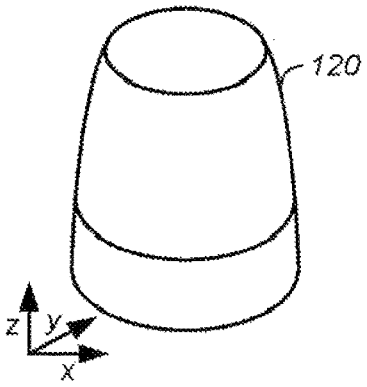
FIG. 10 illustrates a flat nosed bullet.
Figure 11:
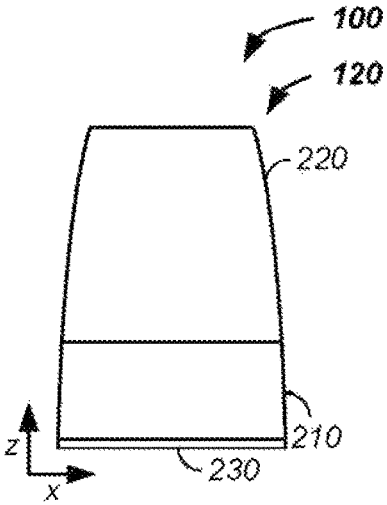
FIG. 11 also illustrates a flat nosed bullet
FIG. 12 further illustrates a flat nosed bullet
Figure 12:
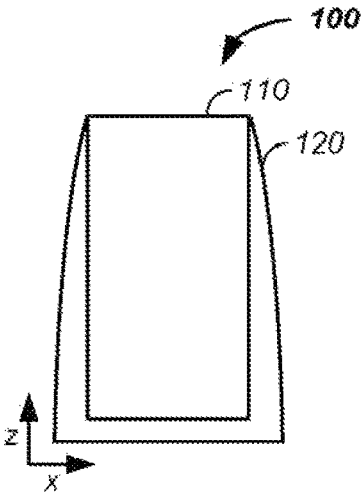

Referring now to FIGS. 10-12, a third bullet type of the projectile 100 is illustrated. The third bullet type optionally and preferably includes the metal core 110 and the jacket 120, as described supra. In this example, the metal core 110 is composed of a desirably dense metal that is also sufficiently weak, brittle, and/or soft as to experience structural failure upon ballistic impact, such as in either brittle or ductile modes upon impact with a hard sporting and/or a competition target, including but not limited to those cut from steel plate of at least 400 Brinell hardness and at least one-quarter inch thickness. The metal core 110 is optionally composed of at least 5, 10, 20, 40, 60, 80, or 90 percent zinc, zinc alloy, copper, copper alloy (including copper alloys 182, 110, and/or 180), lead, lead alloy, bismuth, and/or bismuth alloy. For instance, the metal core 110 is optionally constructed from and/or includes sintered copper alloy to yield a frangible bullet construction. Generally, the metal core 110 is optionally formed of materials designed to deform, fragment, and/or splinter upon striking a target, such as a hard target, and/or are optionally designed to not deform, fragment, and/or splinter upon striking a target, such as a soft target.

Example III

Referring still to FIGS. 10-12, an example of a blunt projectile is provided. A blunt projectile is optionally preferred for sporting and/or competition shooting where it is unfavorable to damage hard targets, such as hard targets cut from steel plate of at least 400 Brinell hardness and at least one-quarter inch thickness. Here, the blunt projectile includes a forward end or tip 410 where the x/y-plane cross-section of the tip 410 is at least 60, 70, 80, or 90 percent of an x/y-plane cross-section at a position of the bearing surface 210. As illustrated, for clarity of presentation and without loss of generality, the tip 410 of the metal core 110 is flat and orthogonal to the symmetrical axis of the projectile 100. In other embodiments, preferred for such use in sport and/or competition shooting, the geometry of the tip 410 is slightly concave, is slightly convex, and/or has any geometry that does not significantly reduce the cross-section area of the tip 410 relative to the widest section of the metal core 110. Such a blunt tip decreases armor penetration ability of a projectile and/or to penetrator due to same mechanics described above that cause pointed tips 410 to increase armor penetration ability.

Example IV

Referring now to FIGS. 2, 4, 8, and 9, the optional chamfer 230 of the projectile 100 is further described. The projectile 100, the core metal 110, and/or the jacket 120 optionally include the chamfer 230, with is useful for aerodynamics and/or in an assembly method, further described infra. As illustrated in FIG. 2, the chamfer is thirty degrees. However, the chamfer is optionally greater than 5, 10, or 15 degrees and less than 40, 50, 60, or 70 degrees. The chamfer 230 is optionally of any geometry.

Example V

In another example, the length of the metal core 110 is described. The metal core is generally greater than 50, 60, 70, 80, 90, 95, 96, 97, 98, or 99 percent of an overall length of the bullet, maximizing a length of the metal core 110 is favorable for achieving a desirable projectile weight for ballistic dynamics. Further, maximizing core length is advantageous for penetrating armor as this also maximizes sectional density relative to an otherwise identical projectile of shorter core length, which increases armor penetration ability by similar mechanics discussed above which cause high compositional density to be favorable for armor penetration. In exemplary optional preferred embodiments, the difference between the length of core and that of the entire projectile is about 0.03" (inches). In other embodiments, the difference in end-to-end length between the metal core 110 and the entire projectile may be a larger or smaller non-zero quantity, and in still other embodiments, the length of the metal core 110 and the entire projectile may be equal.

Bullet Deformation

Referring again to FIG. 1, the projectile 100 is designed for both hard and soft targets. The metal core 110 is designed to penetrate into a hard target. Generally, the jacket 120 will shear off when striking a hard target. However, when the projectile 100 strikes a soft target, the single projectile 100 behaves differently. The metal core 110 will also penetrate into the soft target. However, the jacket 120 will deform upon striking the soft target in a manner that at least increases in a largest x/y-plane cross section, referred here colloquially as increasing in diameter. For clarity of presentation and without loss of generality, deformation properties of the jacket 120 are further described herein by way of examples. Generally, the jacket 120 has a greater radial expansion when striking a soft target, such as a target with a mean elastic modulus value of less 100 kPa and has a smaller radial expansion when striking a hard target, such as a target with a mean elastic modulus value of greater than 1,000 kPa.

Example I

Figure 13A:
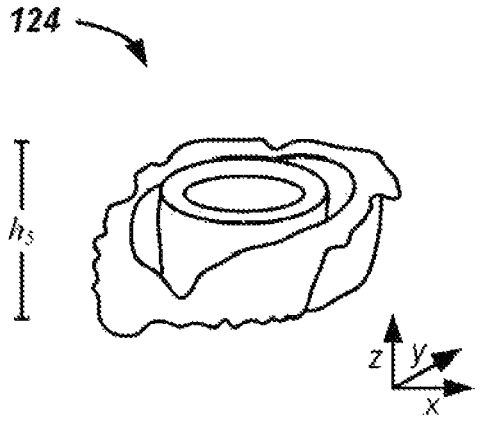
FIG. 13A illustrates a bullet after impact.
Figure 13C:
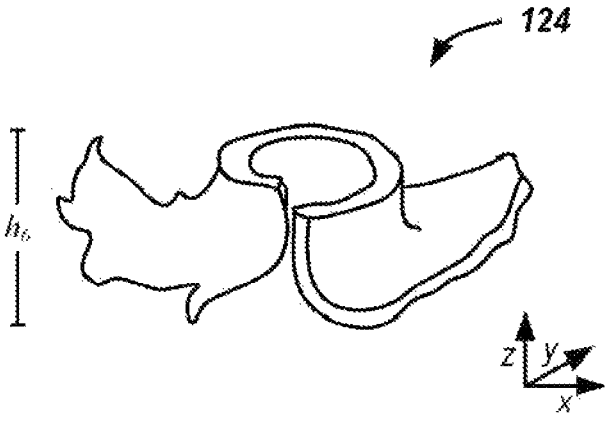
FIG. 13C further illustrates a bullet after impact.
Figure 13B:
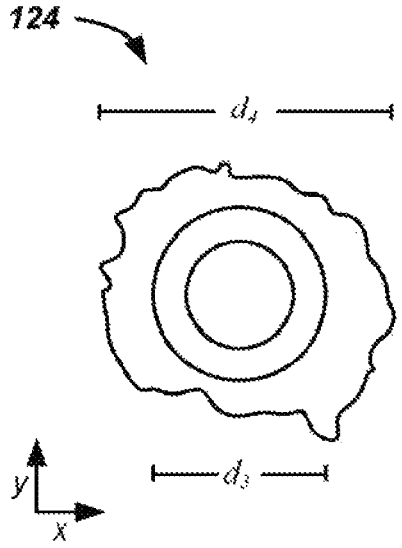
FIG. 13B also illustrates a bullet after impact.

Referring still to FIG. 1 and referring now to FIG. 13A and FIG. 13B, the jacket 120 is depicted in a deformed jacket structure 124 after striking a hard target, such as a IIIa target and/or ballistics armor. In this example, an original length, $l_1$, or height of the projectile of 0.471 inches compressed and/or decreased to a fifth height, $h_5$, of 0.21 inches upon striking the hard target. Further, in this example, an original diameter, $d_3$, of the jacket 120 of 0.356 inches increased to a sheared diameter, $d_4$, of 0.64 inches, the example being a 9 mm bullet striking a hard target. The deformation in shape occurred in a period of less than 40 microseconds. Here, a hard target refers to armor, drywall, wood, and metal. Thus, in this example, when the projectile 100 struck a hard target, the jacket expanded in diameter by 81%. More generally, the diameter of the jacket increased by greater than 25, 50, or 75% and less than 100 or 125 percent in a series of tests.

Example II

Figure 13D:
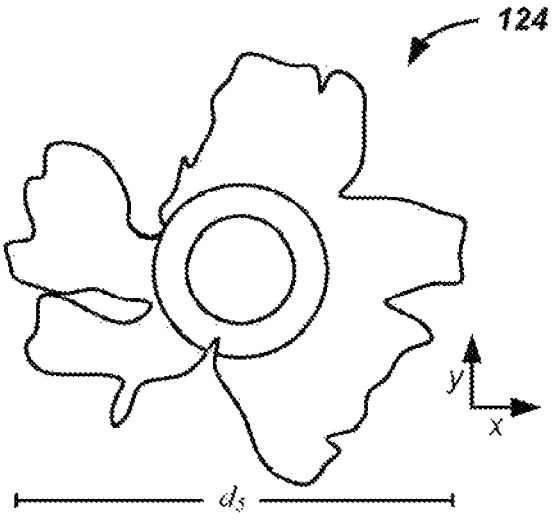
FIG. 13D additionally illustrates a bullet after impact.

Referring still to FIG. 1 and referring now to FIG. 13C and FIG. 13D, the jacket 120 is depicted in a deformed jacket structure 124 after striking a soft target, such as a tissue or an elastic target. In this example, an original length, l.sub.1, or height of the projectile of 0.471 inches decreased to a sixth height, h.sub.6, of 0.226 inches. Further, in this example, an original diameter, d.sub.3, of the jacket 120 of 0.354 inches increased to an expanded diameter, d.sub.5, of 0.934 inches, the example being a 9 mm bullet striking a soft target. The deformation in shape occurred in a period of less than 50 microseconds. Herein, a soft target refers to a ballistics gel and/or to skin, where normal skin has a mean elastic modulus values of 30.3, 14.8, 17.8, and 9.5 kPa for the finger, forearm, chest wall, and abdominal wall, respectively. Herein, a soft target has a mean elastic modulus value of less 100, 75, 50, 40, or 30 kPa and a hard target has a mean elastic modulus value exceeding 1,000 kPa. Thus, in this example, when the projectile 100 struck a soft target, the jacket expanded in diameter by 164%. More generally, the diameter of the jacket increased by greater than 100, 125, 150, 175, or 200 percent in a series of tests.

Manufacturing

Figure 14:
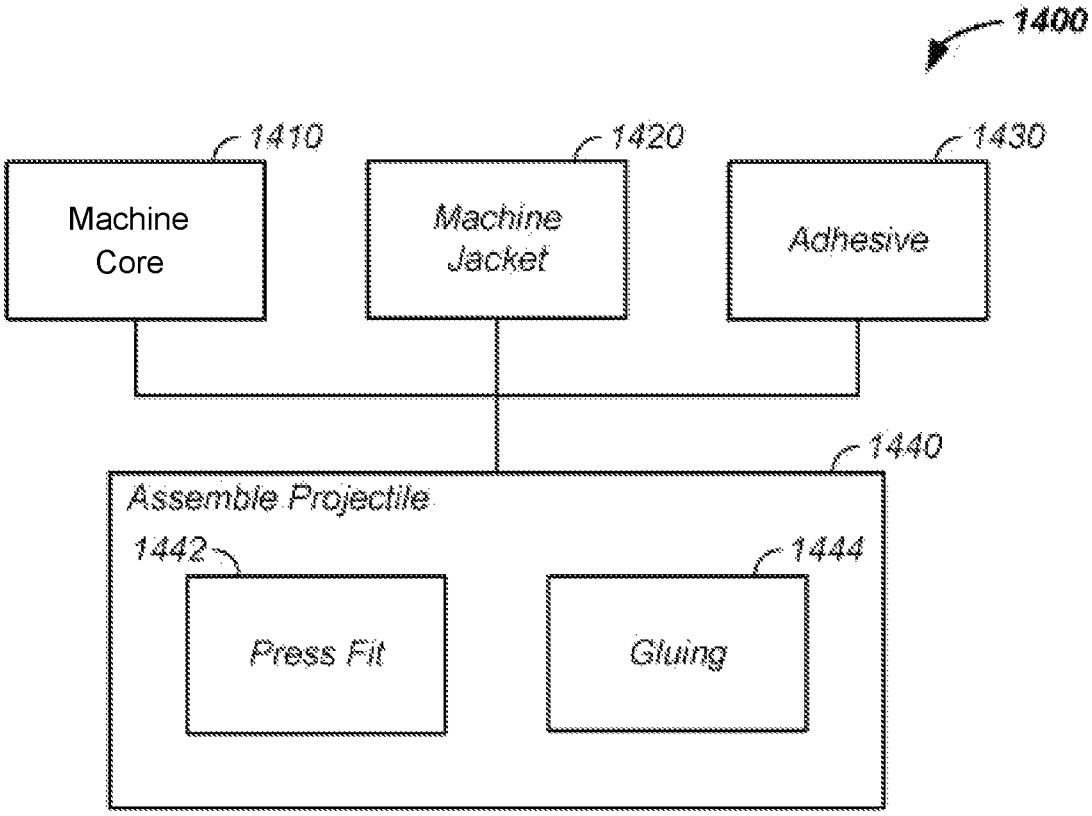
FIG. 14 illustrates a manufacturing process; and,
FIG. 15 illustrates an alternative manufacturing process.
Figure 15:
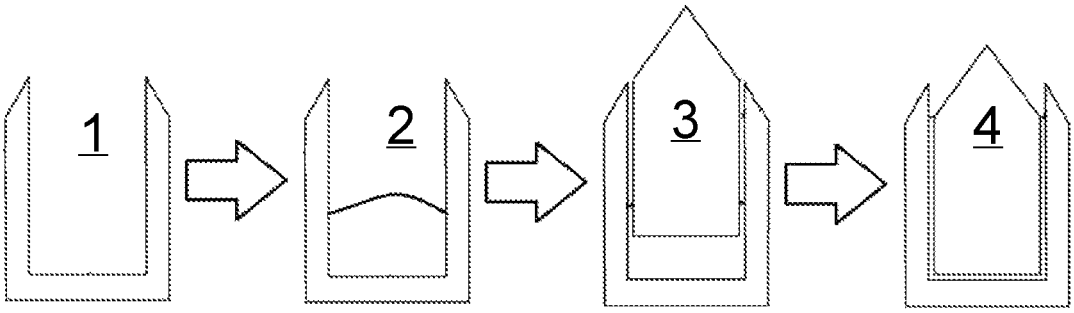

Referring again to FIG. 3 and referring now to FIG. 14, a method of manufacture 1400 of the projectile 100 is described. Generally, the metal core 110 is provided in a first step 1410, such as a result of a forging, sintering, or machining step and/or a metal additive manufacturing printing process. Similarly, the jacket 120 is provided in a second step 1420, such as a result of a machining, molding, and/or a plastic additive manufacturing printing process. Optionally, an adhesive is provided in a third step 1430. In a projectile assembly process 1440, the jacket 120 is pressed onto the metal core 110 in a press fit step 1442 and/or the jacket 120 is glued to the metal core 110 in a gluing step 1444. In the projectile assembly process 1440, the outer surface 340 of the metal core 110 is brought into proximate contact with a joint surface 350 of the jacket 120, where the optional adhesive is placed into a gap 360. Thus, in the optional press fit step 1442, the joint surface 350 of the jacket 120 undergoes a shearing force in the formation of a joint between the joint surface of the jacket 120 and the outer surface 340 of the metal core 110 and/or the joint surface 350 is affixed to the outer surface with the adhesive. Similarly, in the optional gluing step 1444, the joint surface 350 is adhered to the outer surface 340 of the metal core 110 with the adhesive. For clarity of presentation and without loss of generality, examples of the method of manufacture 1400 are provided infra.

Example I

In a first example, the metal core 110 of the projectile 100 is produced by machining solid metal stock. In other embodiments, the metal core 110 is optionally produced by any one or more processes fit for producing metal parts of the described core composition and geometry, including but not limited to, machining, sintering, casting, swaging, and forging. In embodiments preferred for shooting hard sporting targets, including but not limited to those cut from steel plate of at least 400 Brinell hardness of at least ¼" in thickness, such as to prevent damage to the targets, the metal core 110 is produced by sintering in such a way as to impart a frangible quality to the produced metal core 110 similar to more conventional projectiles of frangible construction, but may also be produced by any one or more processes fit for producing metal parts of the described core shape and density, including but not limited to, machining, casting, swaging, and forging.

Example II

In a second example of the manufacturing process, another feature of the projectile 100 is manufacturing from raw materials to complete projectile which may be simpler, and/or which may require simpler and/or more available and/or cheaper tools than manufacturing processes typically employed to produce more conventional projectiles of multi-part construction. Projectiles for use in firearms may require relatively tight and/or precise and/or controllable and/or repeatable geometric dimensioning and/or tolerances. Of production technologies in common use for producing polymer parts of a desired dimension, machining may be generally capable of producing parts of the most precise and/or controllable and/or repeatable dimensions, and therefore preferred embodiments of the described projectile possess the jacket 120 which is produced by machining solid round bar stock. Injection molding can now be as precise as machining and, as a result, therefore other preferred embodiments of the described projectile possess the jacket 120 which is produced via injection molding. Other embodiments may possess the jacket 120, which is produced by any one or more of manufacturing processes commonly referred to as "3D printing", including but not limited to, stereolithography, fused deposition modeling, and selective laser sintering. Stereolithography in particular may be able to produce the jacket 120, such as a polymer jacket, of sufficient precision and other desirable qualities. In still other embodiments, the jacket 120 may be produced using one or more processes suitable to produce polymer parts of a particular shape, including but not limited to, machining, casting, forging, swaging, molding, sintering, and any manufacturing process commonly referred to as "3D printing". Tools for producing the jacket by machining or stereolithography may also be cheaper and more available for home and/or light industrial production. Further, the production of the jacket independent of the core of the described projectile is unique relative to more conventional projectiles, and may see benefit in modularity of the multi-part projectile, allowing the use of interchangeable parts, in this case the core and the jacket, and enjoying the understood manufacturing and/or versatility benefits thereof.

Example III

In a third example of the manufacturing process, stereolithography is used. In the stereolithography process, it is optionally possible that the geometry of parts be somewhat self-supportive during the processes to achieve sufficient dimensional precision. To provide the support, the jacket 120 optionally and preferably includes at least one voluminous portion, where the jacket 120 exhibits a thickness 320 of at least 0.035" (inches) in thickness, which is significantly thicker than conventional projectiles, including those of sheet copper.

Example IV

In a fourth example, in machinability of the jacket 120 some species of polymer are easier to machine than others of the same and some species of polymer are capable of holding more precise and/or repeatable machined dimensions than others of the same. Thus, optionally, the polymer species which composes the jacket 120, has properties favorable to dimensional stability and/or ease of machining if the jacket 120 is to be machined. Polymer species which exhibit such favorable properties include but are not limited to polycarbonate (PC), polyetherimide (PEI), polymethyl methacrylate (PMMA), polyoxymethylene (POM), polyimide (PI); polyamide (PA). Of these, polycarbonate, is optionally and preferably a preferred embodiment for its relatively high durability, economy, machinability, and dimensional stability. Therefore, preferred embodiments of the described projectile possess the jacket 120 composed of polycarbonate. Other embodiments may possess the jacket 120 composed of one or more of any polymer or polymer composite species, including but not limited to those specified above and composites of those specified above.

Example V

In a fifth example, the jacket 120 of the described projectile is monolithic, comprised of a single piece of homogeneous material. In other embodiments, the jacket 120 may be multipart, comprised of more than one piece of homogeneous material.

Example VI

In a sixth example, in embodiments of the described projectile preferred for applications in which capability may be desirable for more severe wounding, such as antipersonnel, hunting, and defense against dangerous and/or threating animals, the jacket 120 extends forward of the outer surface 340 of the metal core 110, which forms a cavity or hollow 310 which is partially bounded by the jacket body 320, and one or both of the core tip 410 and the core body 420. On an occasion that such an embodiment of the projectile is fired into a soft body, that is one which may reasonably be considered a fluid when modeling terminal ballistics, hydrostatic pressure within the jacket body 320 extension may initiate and/or assist expansion and/or fragmentation of the jacket 120 off of and/or away from the metal core 110, similar to the understood expansion dynamics exhibited in more conventional "hollow point" projectiles. The expansion and/or fragmentation may increase severity of a resulting wound, which may be favorable in further incapacitating living targets, including but not limited to game animals and dangerous and/or threatening animals, and personnel. The integration of such increased capacity to expand and/or fragment in soft targets into a projectile which also may excel in penetrating armor, including but not limited to modern engineered armors, is a novel and notable feature which may significantly increase the versatility of the embodiments of the described projectile. For example, a firearm loaded with such ammunition may be more immediately capable of causing maximal damage to both unarmored targets and those which may possess armor.

Example VII

In a seventh example pertaining to projectile assembly: after production of both the metal core 110 and the jacket 120 described above, the parts are assembled to compose the entire described projectile, such that the metal core 110 is fixed within the jacket 120, and the outer surface 340 of the metal core 110 at least partially interfaces with the joint surface 350 of the jacket 120. In optional and preferred embodiments, this is achieved by first aligning the metal core 110 and the jacket 120, such that the axes about which each is generally symmetrical are coincident and/or the joint surfaces, which are the outer surface 340 and the joint surface 350, of each component are concentric, further orienting both components so that the forward end of each faces upward and the metal core 110 lies above the jacket 120, and then pressing or otherwise moving the metal core 110 into the interior space within the jacket body 320 of the jacket 120 so that the rear end of the metal core 110 abuts the floor 330 of the jacket 120. The trailing end 420, optionally and preferably includes a tapered rear geometry exhibited by the metal core 110 of the preferred embodiments is helpful here for proper alignment and/or fitment during this described preferred assembly process. Other embodiments may be assembled in this same or any manner which positions and fixes the metal core 110 properly within the jacket 120 such that the components are properly oriented and positioned relative to each other after assembly, so that the joint surfaces of each component at least partially interfaces with that of the other.

Example VIII

In an eighth example, a quantity of adhesive is utilized to fix the metal core 110 within the jacket 120. In other embodiments, the metal core 110 may be fixed within the jacket 120 by any one or more mechanisms, including but not limited to, adhesive bonding, friction, mechanical fastening, and normal contact force. Further still, the species of adhesive present in optional and preferred embodiments is a tough, low-viscosity cyanoacrylate adhesive such as, but not limited to, LOCTITE® 4014, an ethyl cyanoacrylate adhesive with increased flexibility and peel strength. Other embodiments which may utilize adhesive to fix the metal core 110 within the jacket 120 may utilize any one or more adhesives of any one or more chemistries, including but not limited to cyanoacrylate, epoxy, acrylic, methacrylate, urethane, and silicone.

Example IX

In a ninth example, the quantity of adhesive is dispensed onto the center of the floor 330 of the jacket 120 of the described projectile just before mating with an associated section of the metal core 110. When the metal core 110 is then pressed into the jacket 120 per described preferred assembly, the quantity of adhesive may be pressed adequately into and throughout the gap 360 which may lie between the interfacing joint surfaces of the metal core 110 and the jacket 120. In other embodiments which may utilize a quantity of adhesive to fix the metal core 110 within the jacket 120, the adhesive may be applied by any method which fixes the metal core 110 within the jacket 120 during the course of ballistic flight, and additional adhesive may be used at locations other than the gap 360 between the joint surfaces to fix the metal core 110 within the jacket 120.

Figure 4A:
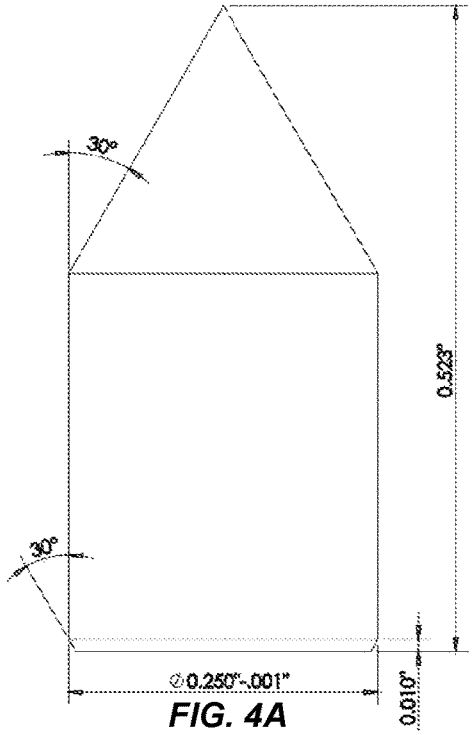
FIG. 4A illustrates the preferred dimensions of a core.

In an exemplary embodiment, a hardness range of the jacket 120 is 55-100 Shore D Hardness. A specific exemplary embodiment of the presented technology pertaining to 9 mm×19 cartridge specification tailored for purposes related to hunting and/or defense against dangerous animals is presented: A core of dimensions shown in FIG. 4A is machined from copper stock of alloy 110 or 182. A polycarbonate jacket of dimensions shown in FIG. 6A is machined or molded. In a first step, the jacket is set upright on its floor. In a second step, while said jacket is standing upon its floor against a flat, level surface, 4.5 grains of LOCTITE® 4014 adhesive is dispensed onto the center of the jacket floor. A third step involves said core being partially inserted into the concavity of the jacket such that the cone of the core faces upwards. In a final or fourth step, the core is pressed firmly against the floor of the jacket, with a force between 10 and 20 pounds, such that said dispensed adhesive is pressed without void formation through the joint surface between the inner cylindrical surface of the jacket and outer cylindrical surface of the core. A mechanical press device may be employed for this purpose as may a presser tool which partially conforms to the conical shape of the jacket. When the adhesive is fully cured, the cohesive projectile comprising said core, said jacket, and said adhesive, weighing about 48.5 grains, is loaded as a component of a cartridge of fixed 9 mm×19 ammunition possessing a cartridge overall length of 1.169 inches and a propellant charge of 9.3 grains of Winchester Autocomp® smokeless powder to produce about 42 ksi of chamber pressure and about 2200 feet per second of muzzle velocity when evaluated to SAAMI standards.

In another embodiment, phosphorescent powder may be added to the polymer material composing the jacket so that the jacket may become identifiable in the dark, including by luminescence when optically charge or charged by mechanical strain. In one embodiment, the phosphorescent material or powder may be mixed into the jacket material prior to molding. In one mode of use, the phosphorescent material may be charged by light including by flash charge. In another embodiment or at the same time, mechanical strain via squeezing the projectile into a gun barrel may supply the luminescent charge. In yet another embodiment, the phosphorescent material provides a tracing effect wherein the projectile jacket is viewable to an observer over a flight path due to the luminescent charge expressing from the jacket after the projectile is released from the gun barrel.

In another exemplary embodiment, a viscosity range of the adhesive is <100, 1000, 2000, 3000, 5000, or 10,000 centipoise (cP). Generally, the adhesive needs to be sufficiently low in viscosity that it is able to flow uniformly through the joint gap between the metal core 110 and the jacket 120, such as in the gap 360, without excessive hydrostatic loading during core setting.

In another exemplary embodiment, a quantity of adhesive is utilized for fixing the metal core into the polymer jacket. Adhesive types which might be used to assemble such projectiles are:

1. Cyanoacrylate (preferably LOCTITE® 4014)
2. Epoxy (including but not limited to 2-part or any other variety of epoxy)
3. Acrylic In addition to the polymer types listed already, other possible polymers are:

1. Polyamide
2. Polyamide-imide
3. Polyphenylsulphone
4. Acrylonitrile butadiene styrene
5. Polyether ether ketone In another exemplary embodiment, the compositions and weights of the core and the jacket are such as to disqualify the projectile as "armor piercing ammunition" defined by the Code of Federal Regulations and/or United States Code, including but not limited to 18 U.S.C. § 921(a)(17)(B), when used in a handgun.

Example X

In a tenth example pertaining to the entire assembled projectile: to ensure legally non-restricted manufacture of the described projectile, in optional and preferred embodiments, the weight of the jacket is less than 25 percent that of the projectile, so to preclude classification as "armor piercing ammunition" by the Code of Federal Regulations and/or United States Code, including but not limited to 18 U.S.C. § 921(a)(17)(B). Such a weight distribution is also a likely result of preferred tailoring of projectile mass, discussed below. Other embodiments, such as those non-compliant to the US federal regulations or for use in exempted purposes, may possess a jacket of more than 25 percent that of the projectile.

The embodiments illustrated are exemplary of innumerably many useful embodiments of the described projectile. There exist preferred embodiments of the described projectile for each caliber of firearm for each described useful application. An aspect of all preferred embodiments of the described projectile is that the total projectile weight is significantly less than that of a more conventional projectile, optionally and preferably by at least 35%, and more preferably by as much as possible, but still high enough to ensure desirable projectile kinetic energy, momentum transfer, and ballistic mechanics as discussed earlier in conjunction with metal core 110 density. This is because a lighter projectile may be propelled faster and with less recoil from a firearm than a heavier projectile fired in an otherwise identical manner, gaining the associated benefits to armor penetration ability and/or ballistic trajectory and/or recoil reduction. Projectile weight may be further tailored in any embodiment by altering the volume of the metal core 110 of the projectile. In an exemplary embodiment of a 9 mm bullet, the total projectile weight is about 50 gr. (grains).

A further quality of preferred embodiments of the projectile is that any volume of void internal to the projectile is minimized. Exemplary embodiments, such as illustrated in FIG. 3, exhibit a minimally small void between the jacket 120 and the chamfer 230 at the trailing end 430 of the metal core 110. Such voids between the jacket 120 and the metal core 110 are preferably as diminutive as possible, as the voids may compromise structural integrity of the projectile, while maintaining the advantages of the geometry which de facto defines and/or bounds them. Further mitigating the structural weakness which may be attributed to the void exhibited in the exemplary embodiments, the quantity of adhesive distributed during assembly at least partially, and preferably entirely, fills the void.

Gap

Another important consideration of the design and/or configuration of an embodiment of the described projectile is the width of the gap 360 between the joint surface 340 of the metal core 110 and a joint surface 350 of the jacket 120. In optional and preferred embodiments, the gap 360 is greater than about 0.0005, 0.001, and/or 0.002 inches and less than 0.003, 0.004, and/or 0.005 inches in width/thickness. The gap 360, when excessively wide, may not sufficiently center the metal core 110 within the jacket 120, which may induce unfavorable ballistic dynamics when fired, and may also inhibit the ability of an adhesive to wick throughout the gap 360 and/or adhere to the entirety of both joint surfaces. The gap 360, when excessively narrow, may also inhibit adhesive flow throughout the gap 360 and/or cause excessive hydraulic pressure during assembly, which may in turn cause structural failure of the jacket 120. In other embodiments, there may be no such measurable gap, such as but not limited to embodiments which utilize an interference fit to fix the metal core 110 within the jacket 120. In still other embodiments, the gap 360 may be of a different width, such as but not limited to embodiments which utilize a more viscous adhesive species.

In optional and preferred embodiments of the described projectile in which the projectile is loaded into a cartridge case for use in a firearm for fixed ammunition, to maximize velocity, the projectile is seated as far forward as possible in the case without exceeding specified cartridge maximum overall length. Further in optional and preferred embodiments, a cartridge of fixed ammunition which includes the projectile contains a propellant charge which, when fired through an exemplary firearm of appropriate caliber and chambering, produces the highest pressure suitable for the given firearm and/or ammunition specification, which may often be referred to as "+P" and/or "+P+". Further still in optional and preferred embodiments, the propellant charge is such to ensure that the action of the firearm, if autoloading, is able to cycle when used with the cartridge including the projectile. Further still, in optional and preferred to embodiments, projectile geometry, including but not limited to ogive 220, overall projectile length, and bearing surface 210, are such as to allow the projectile to be loaded into the cartridge case and fired in the firearm so that overall length of the cartridge is equal to specified maximum cartridge overall length while still maintaining proper fit in the chamber of the firearm, and still maintaining proper function in the firearm, including but not limited to loading, feeding, and extraction functions.

Example XI

In an eleventh example, an optional and preferred embodiment of the projectile 100 is described. The optional and preferred embodiment is a 9 mm caliber armor-penetrating round, where:

I. The metal core 110 is produced of solid UNS R30035, preferably by turning on a lathe. Exact dimensions and critical tolerances are obvious to comprehend by those skilled in reading mechanical drawings. Optional dimensions and features of the metal core 110 include: (1) a cylindrical joint surface 340 of 0.2495-0.2500" in diameter; (2) an overall length of 0.523"; (3) a conical tip 410 at 30 degrees from the joint surface 340, such that the tip 410 ends at a sharp point; and (4) a slight chamfer of about 30 degrees at the rear end 430.

II. The jacket 120 illustrated in FIG. 5 is produced, preferably by stereolithography, or more preferably by turning Polycarbonate on a lathe. FIG. 5 illustrates proper dimensions for this embodiment of 9 mm caliber for armor penetration. Exact dimensions and critical tolerances are obvious to comprehend by those skilled in reading mechanical drawings. Optional dimensions and features of the jacket 120 include: (1) a cylindrical bearing surface 210 of 0.356" in diameter, the front edge of which is 0.13" from the rear end 230; (2) an overall length of 0.471"; (3) a flat floor 330 of 0.010" in thickness; (4) a front end chamfer of 24 degrees producing a sharp front-end edge coincident to the joint surface 350; (5) a cylindrical joint surface 350 of 0.2525-0.2535" in diameter and running from the floor 330 to the front-end edge; (6) a slight chamfer of about 30 degrees at rear end 230, similar to that on the core; (7) a cylindrical ogive 220 portion 0.343" in diameter; and (8) a taper of 5 degrees from bearing surface 210 to cylindrical ogive 220 portion.

III. Both the metal core 110 and the jacket 120 are cleaned of all debris, oil, and/or grease, and thoroughly dried, and the jacket 120 positioned on a digital scale sitting on its rear end.

IV. Two drops of a low viscosity adhesive, such as LOCTITE® 4014, is dispensed onto the center of the floor 330 of the jacket 120, and the metal core 110 is immediately and quickly pressed into the jacket 120 until the metal core 110 is pressed against the floor 330 with a force of 25 pounds as shown on the digital scale. The final position and orientation of the metal core 110 relative to the jacket 120 should match what is illustrated in FIG. 3. It is recommended to use tools to press the metal core 110 which maximize control of the assembly and preclude damage to the tip 410 of the metal core 110, including but not limited to a small arbor press and setter head which does not contact the point of the tip 410.

V. The adhesive is allowed to fully cure before loading into a firearm or cartridge case. Optionally, additional adhesive may be dispensed into the hollow 310 at the forward end of the assembled projectile, so to form a "moat" of adhesive which may partially or completely fill the hollow 310 if additional structural cohesion is necessary or desired.

VI. The finished projectile is to be seated in a cartridge case at maximum cartridge overall length as specified by SAAMI for 9 mm Luger (1.169"), and the inventor finds that a propellant charge of 9.3 gr. (grains) of Winchester Auto-Comp® smokeless powder produces about 42 ksi (kilopounds per square inch) of pressure, commonly referred to as "+P+" for a 9 mm Luger cartridge, when used in the cartridge case in which also is loaded the projectile at the length, in a firearm of SAAMI specification for 9 mm Luger. However, other users may find pressure produced by the loading of fixed ammunition to vary considerably per small differences in production.

The loading may reliably penetrate some modern engineered armors, including some body armors, by virtue of the metal core 110 being composed of a Cobalt alloy.

ADDITIONAL EMBODIMENTS

For clarity of presentation and without loss of generality, additional optional embodiments are described herein.

In another exemplary embodiment, the physical properties of this specified projectile are such as to enable this specified projectile to exhibit an initially flatter trajectory than more conventional projectiles when fired in an otherwise identical fashion without causing excessive damage to many hard sporting targets, including but not limited to targets composed of steel of 400 Brinell Hardness, by virtue of a non-durable composition, blunt shape, and light weight, which enables high velocity.

In another exemplary embodiment, the physical properties of this specified projectile are such as to enable this specified projectile to penetrate armor more effectively than more conventional projectiles when fired in an otherwise identical fashion, by virtue of durable composition, pointed shape, and light weight, which enables high velocity.

In another exemplary embodiment, the physical geometry of this specified projectile is further constructed such as to promote and/or augment expansion and/or fragmentation in terminal ballistics upon impact relative to other projectile designs intended to penetrate armor when fired in an otherwise identical fashion.

In another exemplary embodiment, there is provided a metal core of the projectile of composition and properties which mitigate damage to hard sporting targets shot with the projectile, such as those cut from steel plate of at least 400 Brinell hardness and at least ¼" in thickness, and a method for producing the core.

In another exemplary embodiment, there is provided a metal core of the projectile of composition and properties which enhance armor penetration ability of the core, and a method for producing the core.

In another exemplary embodiment, there is provided a polymer jacket of the projectile and a method for producing the jacket.

In another exemplary embodiment, there is provided a method for assembling and producing the projectile with the constituent components.

In another exemplary embodiment, the construction of the specified projectile is such as to ensure easier and/or cheaper home or light commercial manufacture than more conventional projectiles of multipart construction.

In another exemplary embodiment, both the metal core and the polymer jacket of the specified projectile are produced independent of the other such that the components are interchangeable with others of the same.

In another exemplary embodiment, the projectile may be used for hunting game animals which may possess armor which may otherwise be more difficult to penetrate or when there may be armor positioned between a hunter and a game animal.

In another exemplary embodiment, the projectile may be used in the course of defense against dangerous wildlife and hostile animals, including but not limited to, canines, bears, wildcats, cervids, and bovine which may possess armor which may otherwise be more difficult to penetrate or when there may be armor positioned between a shooter and dangerous wildlife or hostile animals.

In another exemplary embodiment, the projectile may be used for combat against personnel in which there may exist armor positioned between a shooter and the bodies of target personnel.

In another exemplary embodiment, the projectile may be used for combat or hunting or sporting competition in which low recoil may be favored.

In another exemplary embodiment, the projectile may be used for hunting and/or defense against animals and/or combat and/or sporting competition in which a projectile of high velocity and/or flat trajectory and/or lighter recoil is favored.

Dual-Use Projectile

Projectiles designed and used to penetrate armor are typically significantly lacking in terminal performance associated with projectile expansion and/or fragmentation relative to projectiles intended to increase wound trauma, including but not limited to more conventional projectiles of a "hollow point" design, described later. Such terminal trauma is typically desirable in hunting and combat applications, but users must choose between projectiles that optimize wound trauma and those which maximize armor penetration. Herein, a projectile is described that has two uses/functions dependent upon the target. More particularly, herein a single bullet is described that functions as: (1) an expansion/fragmentation bullet when striking a soft/low density target and (2) where the same bullet functions as an armor-penetrating bullet when striking a high density target, such as armor.

In addition, conventional projectiles which more easily and/or greatly experience structural failure on impact with hard targets are typically preferred for shooting sports and competition targets, including but not limited to those cut from steel plate of at least 400 Brinell hardness and at least ¼" in thickness, as they may fail to damage, or minimize damage to, the targets. However, the lighter mass and increased velocity typical of projectiles designed and used to penetrate armor may also be favorable in sporting competitions to reduce recoil and flatten ballistic trajectory, respectively. A projectile may then be uniquely desirable for use in sport and/or competition if it is lighter and faster than more conventional projectiles while also unable to significantly damage hard targets used in sport and competition.

Conventional projectiles may be relatively easy to produce with tools appropriate for home manufacture by casting if composed only of a solid castable element or alloy, or with general tools if machined of copper or copper alloy, but conventional projectiles and many designed and used to penetrate armor which bear any type of jacket require special equipment to apply jackets as a coating or plating, or swage them on, as with sheet copper. Further then, a jacket cannot be fully formed until simultaneously assembled with the core. The first of these factors limits the production of such ammunition only to facilities which possess such specialized tools, potentially increasing cost and decreasing availability. The second of these factors prevents modularity in projectile construction and precludes the versatility and efficiency benefits of interchangeable parts. A projectile construction in which both the core and jacket are independently producible, that is, able to be fully formed independent of the other, may not be limited by either factor.

Still yet another embodiment includes any combination and/or permutation of any of the elements described herein.

Herein, a set of fixed numbers, such as 1, 2, 3, 4, 5, 10, or 20 optionally means at least any number in the set of fixed number and/or less than any number in the set of fixed numbers.

Herein, any number optionally includes a range of numbers such as the number, n, .+−0.1, 2, 3, 4, 5, 10, 20, 25, 50, or 100% of that number.

The particular implementations shown and described are illustrative of the invention and its best mode and are not intended to otherwise limit the scope of the present invention in any way. Indeed, for the sake of brevity, conventional manufacturing, connection, preparation, and other functional aspects of the system may not be described in detail.

Furthermore, the connecting lines shown in the various figures are intended to represent exemplary functional relationships and/or physical couplings between the various elements. Many alternative or additional functional relationships or physical connections may be present in a practical system.

In the foregoing description, the invention has been described with reference to specific exemplary embodiments; however, it will be appreciated that various modifications and changes may be made without departing from the scope of the present invention as set forth herein. The description and figures are to be regarded in an illustrative manner, rather than a restrictive one and all such modifications are intended to be included within the scope of the present invention. Accordingly, the scope of the invention should be determined by the generic embodiments described herein and their legal equivalents rather than by merely the specific examples described above. For example, the steps recited in any method or process embodiment may be executed in any order and are not limited to the explicit order presented in the specific examples. Additionally, the components and/or elements recited in any apparatus embodiment may be assembled or otherwise operationally configured in a variety of permutations to produce substantially the same result as the present invention and are accordingly not limited to the specific configuration recited in the specific examples.

Benefits, other advantages and solutions to problems have been described above with regard to particular embodiments; however, any benefit, advantage, solution to problems or any element that may cause any particular benefit, advantage or solution to occur or to become more pronounced are not to be construed as critical, required or essential features or components.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

I claim:

1. An apparatus, comprising:

a projectile, comprising:

(a) a metal core comprising a base and a tip, said base and said tip separated by a core length along a z-axis, said z-axis running longitudinally through a center of said metal core; and, (b) a jacket circumferentially attached to said metal core, said jacket surrounding at least fifty percent of the core length of said metal core, said jacket comprising a polymer, a first jacket radial thickness along at least a section of an interquartile portion of said core length of greater than 0.03 inches, and less than twenty-five percent of a total mass of said projectile.

2. The apparatus of claim 1, said jacket further comprising:

a cylindrical geometric section comprising a smooth outer-surface along at least twenty percent of said interquartile portion.

3. The apparatus of claim 1, wherein the metal core is consisting of at least five, ten, twenty, forty, sixty, eighty, or ninety percent by mass of a metal alloy selected from the group consisting essentially of a copper alloy, tungsten alloy, steel alloy.

4. The apparatus of claim 3, said metal core further comprising:

a metal core radial thickness along said interquartile portion of said core length, wherein a ratio of said first jacket radial thickness-to-said metal core radial thickness comprises at least forty percent.

5. The apparatus of claim 3, said jacket consisting of at least one of:

polycarbonate;
polyetherimide;
polymethyl methacrylate;
polyoxymethylene,
polyimide;
polyamide;
Polyamide-imide;
Polyphenylsulphone;
Acrylonitrile butadiene styrene; and,
Polyether ether ketone.

6. The apparatus of claim 2, said jacket further comprising:

a second jacket radial thickness along at least a section of a lower quartile of the core length relative to said base, said second jacket radial thickness at least ten percent thicker than said first jacket radial thickness.

7. The apparatus of claim 2, said projectile comprising:

a ratio of a first total mass of said jacket-to-a second total mass of said metal core exceeding twelve percent.

8. The apparatus of claim 3, said metal core further comprising:

a tensile strength in a range of 40 to 300 kilopounds per square inch.

9. The apparatus of claim 2, said jacket further comprising:

a cylindrical section; and a base section attached to said cylindrical section, said metal core positioned both: (1) on said base section and (2) within said cylindrical section.

10. The apparatus of claim 2, said cylindrical geometric section further comprising:

a cylindrical section length less than said core length.

11. The apparatus of claim 2, said metal core comprising a sintered copper alloy.

12. The apparatus of claim 2, further comprising:

an adhesive comprising a layer bonding an outer surface of said metal core to an inner joint surface of said jacket.

13. The apparatus of claim 12, said adhesive further comprising:

a pre-hardened viscosity in a range of 1 to 10,000 centipoise.

14. The apparatus of claim 2, wherein said projectile is not "armor piercing" as defined by 18 U.S.C. § 921.

15. The apparatus of claim 12 wherein said adhesive is selected from a group of adhesives consisting essentially of 1. Cyanoacrylate
2. Epoxy
3. Acrylic.

16. A method of assembling a projectile comprising the steps of:

producing a metal core comprising a base and a tip, said base and said tip separated by a core length along a z-axis, said z-axis running longitudinally through a center of said metal core;

producing a polymer jacket comprising a base section attached to a hollow cylindrical section with a first jacket radial thickness along at least a section of said cylindrical section of greater than 0.03 inches;

applying an adhesive to a floor of said base section at a location that is within said hollow cylindrical section;

positioning the metal core within said cylindrical core without a interference-fitted connection thereto such that said jacket surrounds at least fifty percent of the core length of said metal core and such that said adhesive forms a layer bonding an outer surface of said metal core to an inner joint surface of said jacket.

17. The method of claim 16, wherein the metal core is composed of at least five, ten, twenty, forty, sixty, eighty, or ninety percent by mass of a copper alloy.

18. The method of claim 17, wherein said metal core further comprises:

a metal core radial thickness along said interquartile portion of said core length, wherein a ratio of said first jacket radial thickness-to-said metal core radial thickness comprises at least forty percent.

19. The method of claim 17 wherein the step of producing the metal core further comprises the step of machining, sintering, or forging the metal core.

20. The method of claim 17 wherein the step of producing the polymer jacket consists of the step of machining, injection-molding, or printing the polymer jacket.

21. The method of claim 17, wherein said metal core further comprises:

a sintered copper alloy.

22. A projectile according to claim 1 wherein: when the projectile is fired into a fluid-like body, hydrostatic pressure within the jacket initiates expansion and/or fragmentation of the jacket off of and/or away from the metal core.

23. A projectile according to claim 1 wherein: the jacket comprises a material that luminesces when optically charged or charged by mechanical strain.

24. A projectile defined by:

a metal core that is geometrically defined by tip and a cylinder at the base, where said tip features an outer surface that is seamlessly joined to the outer surface of the cylinder, where the cone and cylinder share a diameter and a coaxis;

a polymer jacket that features a cylindrical receptacle wherein the metal core is disposed, said jacket further featuring a tip defined around the cylindrical receptacle, wherein the tip is defined by an angled edge of the cylindrical receptacle and extends forward of the outer surface of the cylinder such that a cavity or hallow is formed; and wherein the diameter of the cylindrical receptacle is configured to expand by more than one-hundred percent when the tip of the jacket contacts an unarmored target and wherein the tip of the metal core is configured to penetrate an armored target.

* * * * *